US010327558B2

(12) United States Patent
Souders

(10) Patent No.: US 10,327,558 B2
(45) **Date of Patent: *Jun. 25, 2019**

(54) MULTI-CONFIGURABLE FURNITURE SYSTEM

(71) Applicant: Gary Hamilton Souders, Defuniak Springs, FL (US)

(72) Inventor: Gary Hamilton Souders, Defuniak Springs, FL (US)

( * ) Notice: Subject to any disclaimer, the term of this patent is extended or adjusted under 35 U.S.C. 154(b) by 25 days.

This patent is subject to a terminal disclaimer.

(21) Appl. No.: 15/717,381

(22) Filed: Sep. 27, 2017

(65) Prior Publication Data

US 2018/0103767 A1 Apr. 19, 2018

Related U.S. Application Data

(63) Continuation of application No. 15/272,506, filed on Sep. 22, 2016, now Pat. No. 9,833,079.

(Continued)

(51) Int. Cl.

| | |
|---|---|
| ***A47C 13/00*** | (2006.01) |
| ***A47B 85/04*** | (2006.01) |
| ***A47B 39/00*** | (2006.01) |
| ***A47C 7/00*** | (2006.01) |
| ***A47B 3/10*** | (2006.01) |

(Continued)

(52) U.S. Cl.

CPC ..... *A47C 13/005* (2013.01); *A47B 3/10* (2013.01); *A47B 7/02* (2013.01); *A47B 9/04* (2013.01); *A47B 25/00* (2013.01); *A47B 2220/01* (2013.01); *A63F 1/067* (2013.01); *A63F 7/0628* (2013.01); *A63F 9/0402* (2013.01);

(Continued)

(58) Field of Classification Search

CPC .. A47B 3/14; A47B 3/002; A47B 3/06; A47B 9/14; A47B 9/12; A47B 9/20; A47B 13/08; A47B 37/00; A47B 3/12; A47B 9/00; A47B 13/02; A47B 13/023; A47C 13/005; A63F 9/0402; A63F 5/00; A63F 1/067; A63F 7/0023

USPC ..... 297/108, 109, 118, 119, 121, 135, 140, 297/234, 235, 440.1, 440.14; 108/150

See application file for complete search history.

(56) References Cited

U.S. PATENT DOCUMENTS 33,644 A * 11/1861 Hardie ..... A45C 9/00 190/2

321,825 A * 7/1885 Koenig ..... A47C 17/2073 297/108

(Continued)

*Primary Examiner* — Rodney B White

(74) *Attorney, Agent, or Firm* — GrayRobinson, P.A.

(57) ABSTRACT

A modular table comprising a main table body having a center portion, a mid-section which is disposed vertically underneath the main table body wherein the mid-section is adapted to provide vertical support to the main table body. An alternative embodiment of the table has a center portion of the main table body which is telescopically expandable allowing the mid-section to become vertically disposed. This telescopic expansion can be achieved using jack screws or rotatable mid-section. The table trunk is capable of housing a plurality of stools or chairs. The stools or chairs can be coupled together and, when placed end to end, provide a further base for the main table body due to a notch which is formed and which fits an extension which protrudes downwardly from the main table body. The main table body can also have a reversible table top which can be designed to be a gaming board or a bar top.

24 Claims, 30 Drawing Sheets

Related U.S. Application Data

(60) Provisional application No. 62/240,110, filed on Oct. 12, 2015, provisional application No. 62/222,426, filed on Sep. 23, 2015.

(51) Int. Cl.

| | |
|---|---|
| ***A47B 7/02*** | (2006.01) |
| ***A47B 9/04*** | (2006.01) |
| ***A47B 25/00*** | (2006.01) |
| *A63F 9/04* | (2006.01) |
| *A63F 1/06* | (2006.01) |
| *A63F 7/06* | (2006.01) |
| *A63F 7/36* | (2006.01) |
| *A63F 3/00* | (2006.01) |

(52) U.S. Cl.
CPC ..... *A63F 2003/00164* (2013.01); *A63F 2003/00974* (2013.01); *A63F 2007/3674* (2013.01)

(56) References Cited

U.S. PATENT DOCUMENTS 378,553 A * 2/1888 Porter ..... A47B 23/02 297/135
885,234 A * 4/1908 Erikson ..... A47C 17/2073 297/106
993,101 A * 5/1911 Press ..... A47C 17/2073 297/108
1,926,915 A * 9/1933 Ramirez ..... A47C 17/165 297/109
1,956,483 A * 4/1934 Alpers ..... A47B 3/14 108/25
1,961,457 A * 6/1934 Schnelder ..... A47B 85/04 297/121
2,030,195 A * 2/1936 Breese ..... A47B 7/02 108/91
2,149,120 A * 2/1939 Janes ..... A47B 85/04 297/119
D144,591 S * 4/1946 Schutes ..... 297/140
D154,453 S * 7/1949 Schukat ..... 297/140
D159,534 S * 8/1950 Raichert ..... 297/140
D165,554 S * 12/1951 Schukat ..... 297/140
2,582,553 A * 1/1952 McMurtrie ..... A63H 33/108 211/189
2,614,018 A * 10/1952 Engel ..... A47B 83/045 108/33
3,233,942 A * 2/1966 Creutz ..... A47B 85/00 297/118
3,234,896 A * 2/1966 Bonsall ..... A47B 87/0246 108/60
3,496,670 A * 2/1970 Ryan ..... A63H 33/088 446/104
3,550,310 A * 12/1970 Bock-Greissau ..... A63H 33/04 273/155
3,561,757 A * 2/1971 Schillig ..... A63B 9/00 434/403
3,583,780 A * 6/1971 Berkowitz ..... A47B 47/042 312/108
3,596,396 A * 8/1971 Thomson ..... A63F 9/088 273/155
3,644,008 A * 2/1972 Overby ..... A47B 87/0253 312/107
3,655,065 A * 4/1972 Yellin ..... A47B 47/042 108/151
3,773,329 A * 11/1973 Secter ..... A47C 13/005 273/153 R
3,790,241 A * 2/1974 Messina ..... A47B 87/0253 297/440.14
3,822,924 A * 7/1974 Lust ..... A47B 47/0041 312/108
3,872,975 A * 3/1975 Silver ..... A47B 43/02 108/162
4,223,945 A * 9/1980 Nikitits ..... A47B 3/14 108/166
4,875,681 A * 10/1989 Ofir ..... A63F 9/088 273/155
4,903,451 A * 2/1990 Gresswell ..... A47B 87/0276 312/111
5,154,656 A * 10/1992 Milstein ..... A63H 33/04 434/259
5,466,058 A * 11/1995 Chan ..... A47B 47/0075 312/107
D387,571 S * 12/1997 Schweter ..... D6/335
5,833,333 A * 11/1998 Brown ..... A47B 83/00 312/235.1
6,063,007 A * 5/2000 Sithole ..... A63B 23/0458 297/440.14
6,068,331 A * 5/2000 Barnes ..... A47B 83/04 108/180
6,155,641 A * 12/2000 Frost ..... A47C 3/20 108/11
6,174,026 B1 * 1/2001 Wise ..... A47B 85/00 108/17
6,827,028 B1 * 12/2004 Callaway ..... A47B 3/06 108/157.1
RE38,836 E * 10/2005 Krause ..... A47B 87/007 312/108
7,014,267 B1 * 3/2006 Nagar ..... A47B 47/0008 297/440.14
7,322,642 B2 * 1/2008 BoJack ..... A47B 83/001 297/135
D587,475 S * 3/2009 Ren ..... D6/349
7,533,940 B1 * 5/2009 Zook ..... A47B 83/02 108/11
7,866,769 B2 * 1/2011 Ahlgrim ..... A47B 43/02 312/108
7,942,485 B2 * 5/2011 Castelluccio ..... A47B 85/08 312/195
8,388,073 B2 * 3/2013 Richter ..... A47B 47/025 312/108
8,695,795 B1 * 4/2014 Huber ..... A47B 87/0292 206/308.1
8,783,779 B2 * 7/2014 Wittenberg ..... A47C 31/11 297/228.1
9,078,515 B2 * 7/2015 Keragala ..... A47B 47/042
9,237,803 B2 * 1/2016 Kassanoff ..... A47B 47/0091
9,833,079 B2 * 12/2017 Souders ..... A47C 13/005
2007/0052276 A1 * 3/2007 Hurvich ..... A47C 13/005 297/440.14
2010/0019630 A1 * 1/2010 Leng ..... A47B 47/0075 312/107
2010/0176697 A1 * 7/2010 Fuerstenau ..... A47B 87/008 312/198
2010/0237755 A1 * 9/2010 Zalewski ..... A47B 47/0041 312/111

* cited by examiner 20
26
30
24
56
16

Fig. 29
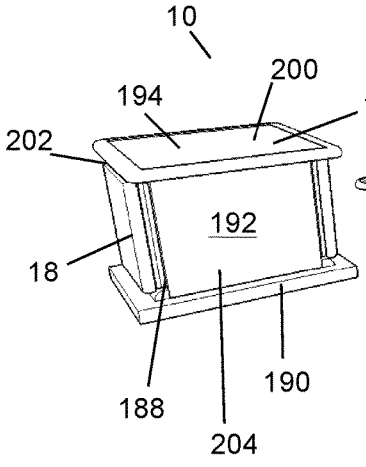
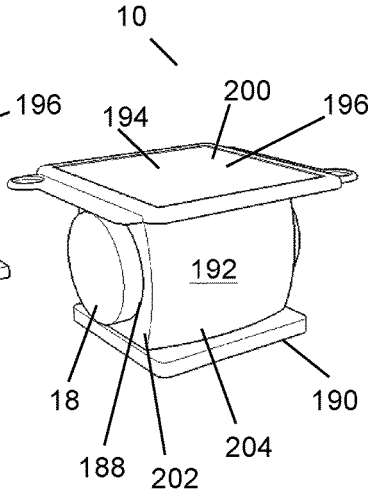
Fig. 30
Fig. 31
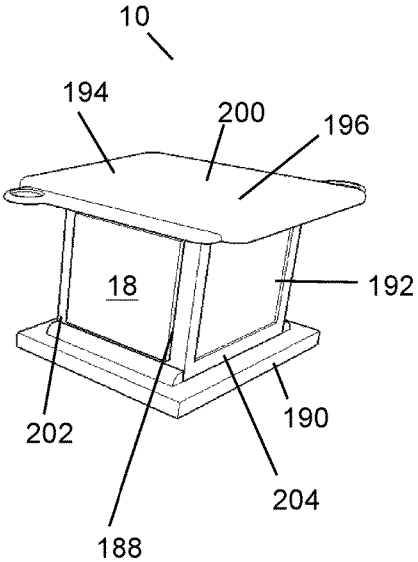

MULTI-CONFIGURABLE FURNITURE SYSTEM

RELATED APPLICATION DATA

This application is a continuation of application Ser. No. 15/272,506 filed on Sep. 22, 2016 entitled "Multi-Configurable Furniture System" which claims priority to Provisional Application No. 62/222,426 filed on Sep. 23, 2015 entitled "Multi-Configurable Furniture System" and to Provisional Application No. 62/240,110 filed on Oct. 12, 2015 entitled "Coffee Table Bar". The content of these applications are fully incorporated herein for all purposes.

TECHNICAL FIELD

This disclosure relates to a table. More specifically, this disclosure relates to a modular table having removable stools which can be stored within the base of the table and an elevation-adjustable tabletop which can use jack screws or a removably rotatable mid-section to affect the height of the table.

BACKGROUND OF THE INVENTION

Tables are used around the world to allow residents of a home to place things, eat, or put their feet up and relax. There presently exist tables, for example, which use hinges to lift the table top closer to the eye level of the user. However, presently there exists a need for a table which is multi-functional and can adapt to the need of the user. For example, present tables do not provide seating nor do they provide modularity so as to allow a user to turn the table top into a game board or wine rack or paper towel dispenser or any other useful addition.

Thus, there presently exists a need for a table having the described modularity and storage capabilities. The present invention provides storage for stools or chairs as well as modularity as to the height and use of the table top. Other tables have been designed in an attempt to reach this goal but none have the desired efficiency and reliability.

Therefore, it is an object of this invention to provide improvements which overcome the aforementioned inadequacies of the prior art devices and methods and provide and improvement which is a significant contribution to the advancement of table art.

Another object of this invention is to provide a table which can store a set of stools or chairs.

Another object of this invention is to provide a table which can be raised or lowered using jack screws.

Another object of this invention is to provide a table which is modular such that the user can rearrange the structure of the coffee table to the user's desired arrangement.

Another object of this invention is to provide a table which can be turned into a gaming table quickly and efficiently.

Another object of this invention is to provide a table which saves space by storing various components within itself when not in use.

Another object of this invention is to provide stools which have a cavity to receive a table top or bench and hold the stools together while the table is being used as a table.

Another object of this invention is to provide a table which can be turned into a bar.

Another object of this invention is to provide a table having a manual method of lifting or lowering the height of a table top or bench.

The foregoing has outlined some of the pertinent objects of this invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a modular table comprising a main table body having a center portion, a mid-section which is disposed vertically underneath the main table body wherein the mid-section is adapted to provide vertical support to the main table body. An alternative embodiment of the table has a center portion of the main table body which is telescopically expandable allowing the mid-section to become vertically disposed. This telescopic expansion can be achieved using jack screws or rotatable mid-section. The table trunk is capable of housing a plurality of stools or chairs. The stools or chairs can be coupled together and, when placed end to end, provide a further base for the main table body due to a notch which is formed and which fits an extension which protrudes downwardly from the main table body. The main table body can also have a reversible table top which can be designed to be a gaming board or a bar top.

An alternative embodiment of the invention comprises a table having a telescoping body which uses jack screws to raise and/or lower the height of the table. This embodiment features storage space for stools which are substantially similar to the stools used in the first embodiment. The table top is also modular and can be modified into any number of designs.

Another alternative embodiment of the invention comprises a table having space for stool storage. The stools used in this embodiment can have any number of interlocking designs such that the stools interlock when placed within the table.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures and methods for carrying out the same purposes of the present invention. It should also be realized by those skilled in the art that such equivalent constructions and methods do not depart from the spirit and scope of the invention as set forth in the appended claims.

BRIEF DESCRIPTION OF THE DRAWINGS

For a more complete understanding of the present disclosure and its advantages, reference is now made to the following descriptions, taken in conjunction with the accompanying drawings, in which:

FIG. 29 is a perspective view of an alternative embodiment of the table.

FIG. 30 is a perspective view of an alternative embodiment of the table.

FIG. 31 is a perspective view of an alternative embodiment of the table.

Similar reference numerals refer to similar parts throughout the several views of the drawings.

DETAILED DESCRIPTION OF THE DRAWINGS

The present invention relates to a table which is modular and which can store a plurality of stools or chairs. The various components of the present invention, and the manner in which they interrelate, are described in greater detail hereinafter.

Figures 1, 2:
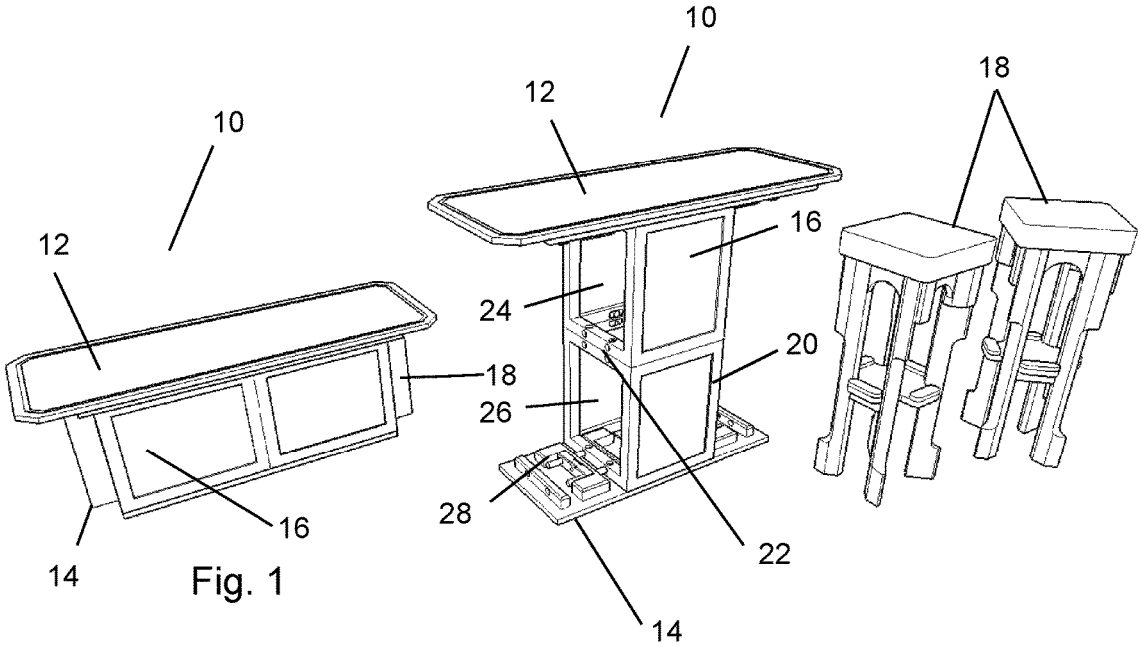
FIG. 1 is a perspective view of one embodiment of the table when it is in the coffee table position.
FIG. 2 is a perspective view of the table from FIG. 1 when it is in the bar position and with the stools removed and placed upright.

As can be seen in FIGS. 1 and 2, the table 10 comprises a table top 12, a base 14, a mid-section 16, and a plurality of stools 18. The stools 18 fit within mid-section 16 when the table 10 is in the "table" position. The table 10 can be any style or design as preferred by the user. Similarly, the table 10 can be modified to include other components or options such as a wine glass holder, cup holder, or chip rack. The base, which is shown in further detail in FIG. 5 and described below, has a series of protrusions 28 used to keep the mid-section 16 in the desired position.

Figures 3A, 3B, 3C, 3D:
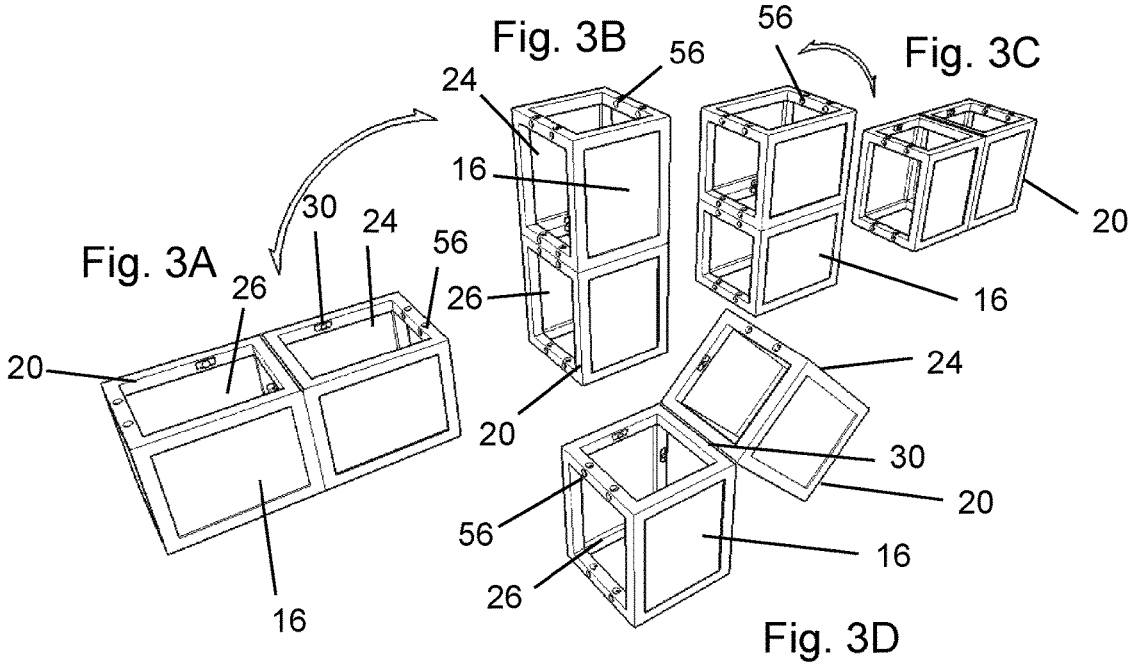
FIGS. 3A-3D are perspective views of the hinging mid-section of the table.

As can be seen in FIG. 3A through 3D, the mid-section 16 comprises two frames 20 which are preferably connected by a hinge 22. Each frame 20 is preferably rectangular and is comprised of a first opening 24 and second opening 26. The hinge 22 allows the mid-section 16 to change the height/length of the mid-section 16. The frames 20 are preferably laid length-wise in connection with the base 14 when the table 10 is in the "table" position, as shown in FIG. 3A. The frames 20 are preferably vertically positioned and in connection with the base 14 when the table is in the "bar" position, as shown in FIG. 3B. The height of the table 10 in either position can be raised or lowered by folding the frames 20 using the hinge 22 and rotating based on the desired position of either "table" or "bar" as can be seen in FIGS. 3C and 3D. Each frame 20 has at least one position latch 30 which will lock frame 20 into position. Preferably, the position latch 30 is placed strategically so that each frame 20 of mid-section 16 is symmetrical.

Figure 4:
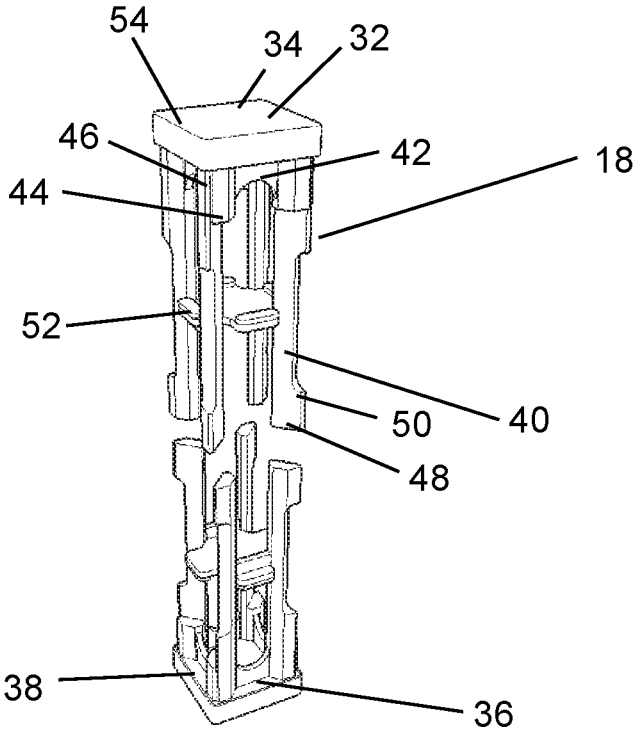
FIG. 4 is a perspective view of the stools.

FIG. 4 shows a variation of the stool 18 which can be placed within the mid-section 16. The stool 18 has a seat 32 having a seat top side 34 and seat bottom side 36. Seat bottom side 36 has a plate 38 which connects to a plurality of legs 40. Each leg 40 has a support 42 connecting the leg 40 to a proximate leg 40. Each leg 40 also has a leg stop 44 attached to it at a first leg end 46 which adds strength and style but also limits the movement of the stool 18 when stowed in the table 10. Each leg 40 has a leg end piece 48 at a second leg end 50 which interconnects with the leg end 48 of a second stool 18. When two stools 18 are interconnected, they can form a bench, which is described below in FIG. 7, as each leg end 48 continues along each leg 40 until it reaches leg stop 44. Each leg 40 has a foot plate heel rest 52 which is used to support each leg 40 and for the user to rest their foot while in use. The seat 32 preferably has a cushion 54 attached or on top for comfort and are preferably foam rubber or padding and may have a decorative cover.

Figure 5:
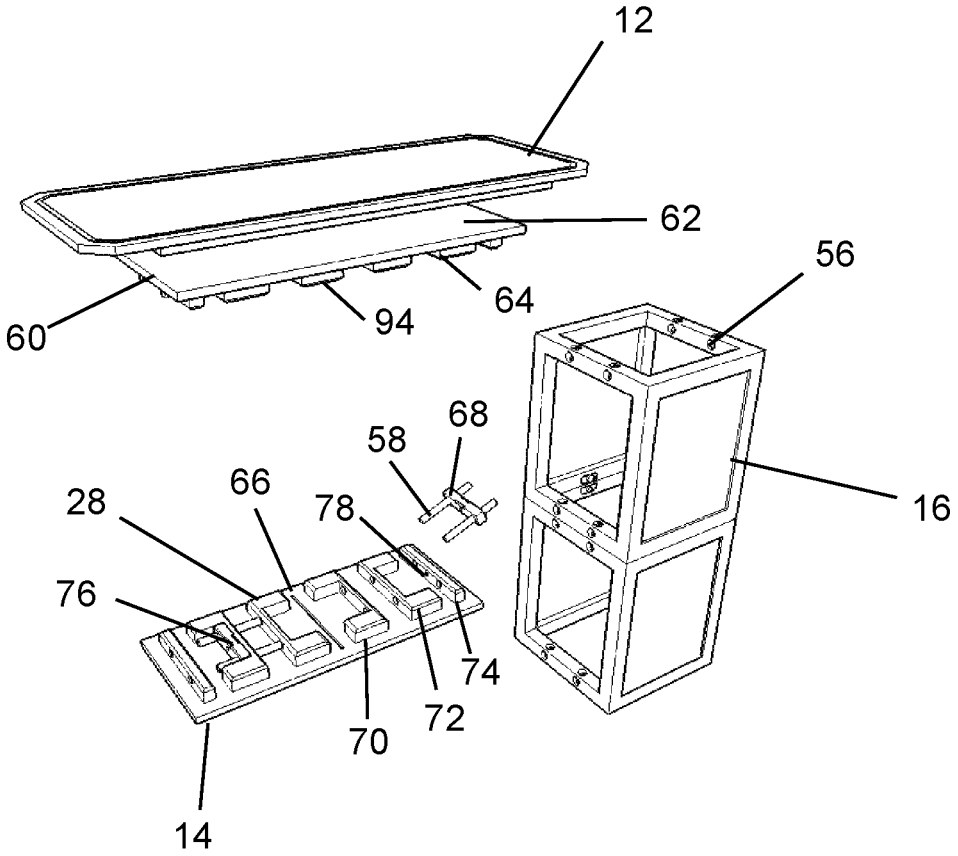
FIG. 5 is an exploded view of the table top, the hinging mid-section, the slide latch, and the base.

FIG. 5 provides a more detailed view of the base 14 and hinge 22. The base 14 comprises a plurality of protrusions 28 which lock the mid-section 16 into the desired position. The mid-section further comprises height adjustment holes 56 to be used with slide latch pins 58. The slide latch pins 58 lock into the height adjustment holes 56 to lock the mid-section 16 into place with the base 14 using a slide latch 68. The table top 12 is preferably a flat surface and is placed on the portion of the mid-section 16 facing upward using a platform frame 60. The platform frame 60 has a flat top surface 62 and bottom surface 64 which connects to the position extrusions 94 which allow for slide latch pins 58 to lock the mid-section 16 into place. The base 14 has an indentation 66 extending across the width of the base 14 for the hinge 22 to rest and to have the mid-section be level when in place.

Figure 6:
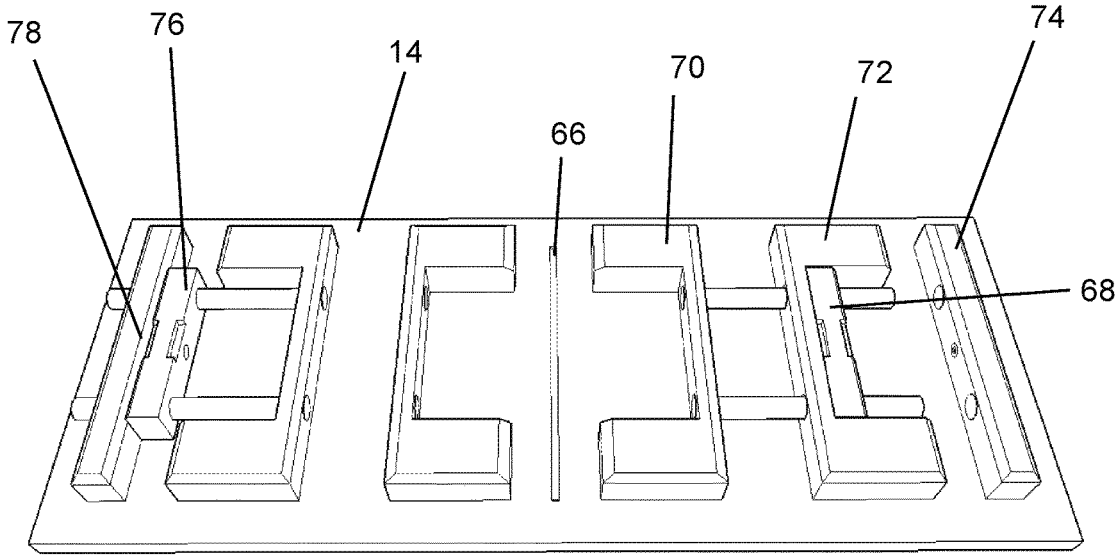
FIG. 6 is a perspective view of the base.

FIG. 6 is a close-up view of the base 14 showing the slide latch 68. The base 14 performs this function by connecting to the first opening 24 or second opening 26 using the protrusions 28. Inner protrusions 70 and middle protrusions 72 and outer protrusions 74 define where the mid-section 16 can be placed. Placing either the first opening 24 or the second opening 26 on the inner protrusions 70 results in the "bar" position when the mid-section 16 is positioned vertically. Placing either the first opening 24 or the second opening 26 on the inner protrusions 70 and middle protrusions 72 results in the "table" position when the mid-section 16 is positioned horizontally. Once the mid-section 16 is in place the slide latch 68 can be put into place, locking the mid-section into position and stabilizing the table 10. The outer protrusions 74 serve to act as a final position when supporting the table 10 at its lowest height. The slide latch 68 allows the middle protrusions 72 to slide along the length of the base 14 to provide for proper placement of the mid-section 16. When the middle protrusions 72 are closer to the inner protrusions 68, the base 14 is ready to accept the mid-section 16 to form the "table" position. When the middle protrusions 72 are further from the inner protrusions 68, the base 14 is ready to accept the mid-section 16 to form the "bar" position. The middle protrusions 72 can be held against the outer protrusions 74 through the use of a magnet 76 and magnet striker 78. The magnet 76 is preferably attached to each middle protrusion 72 and the magnet striker 78 is preferably attached to each outer protrusion 74.

Figure 7:
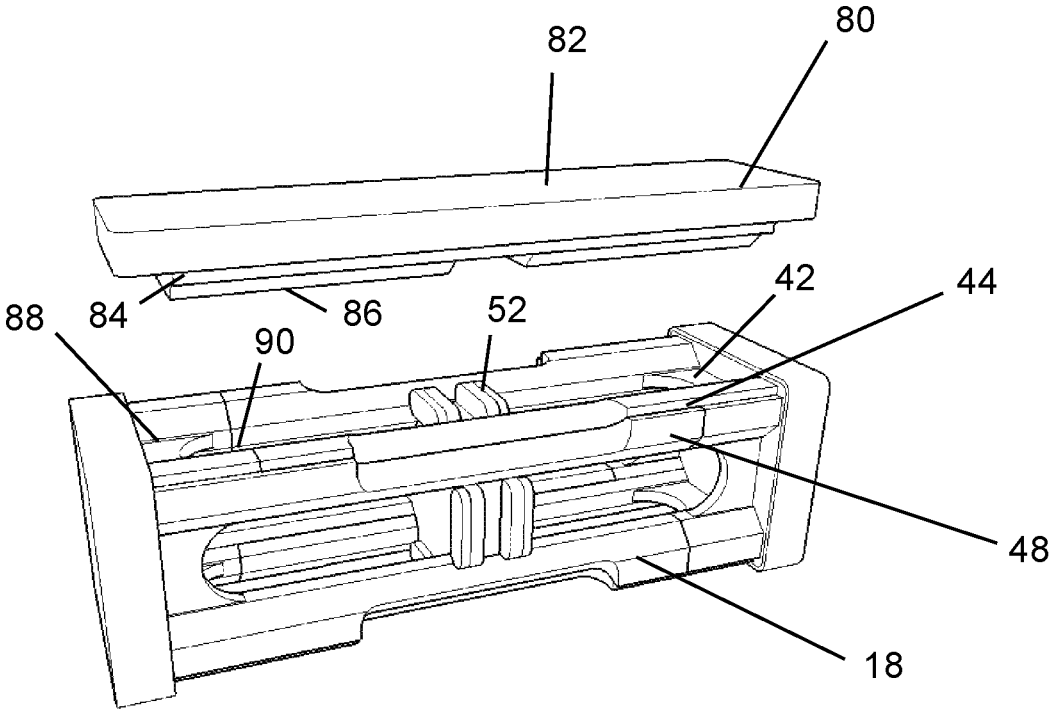
FIG. 7 is a perspective view of connected stools and the table top showing the notch and protrusion holding the stools and table top together when in position.
Figure 8:
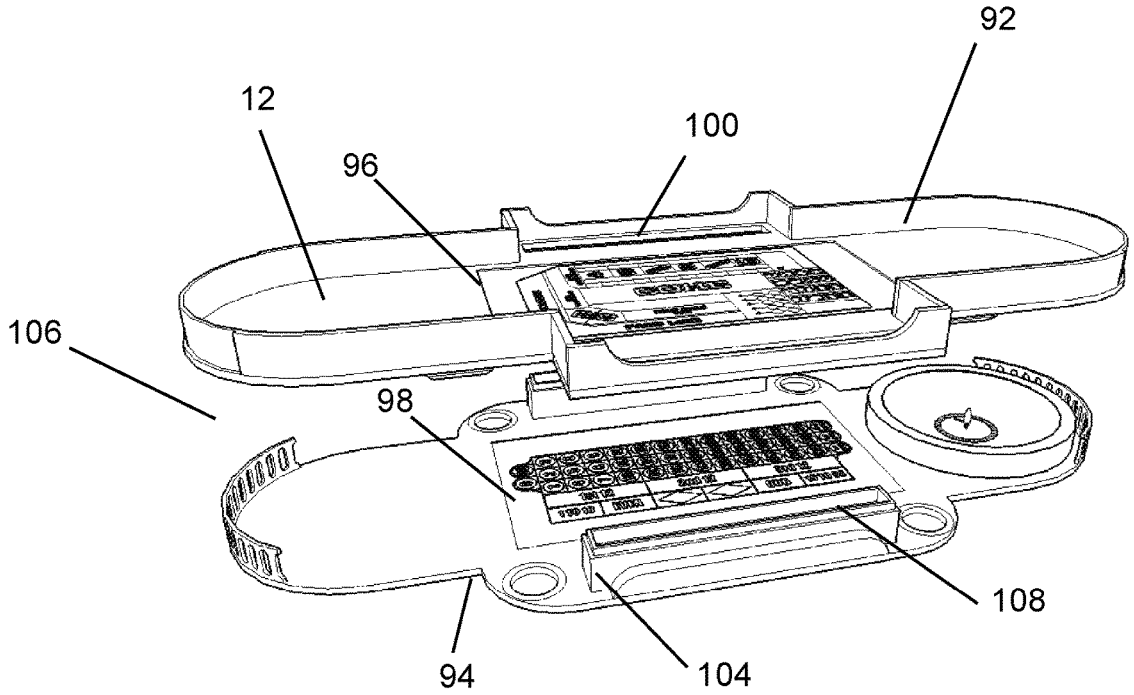
FIG. 8 is a perspective view of an embodiment of the table top which incorporates craps or roulette table games.
Figure 9:
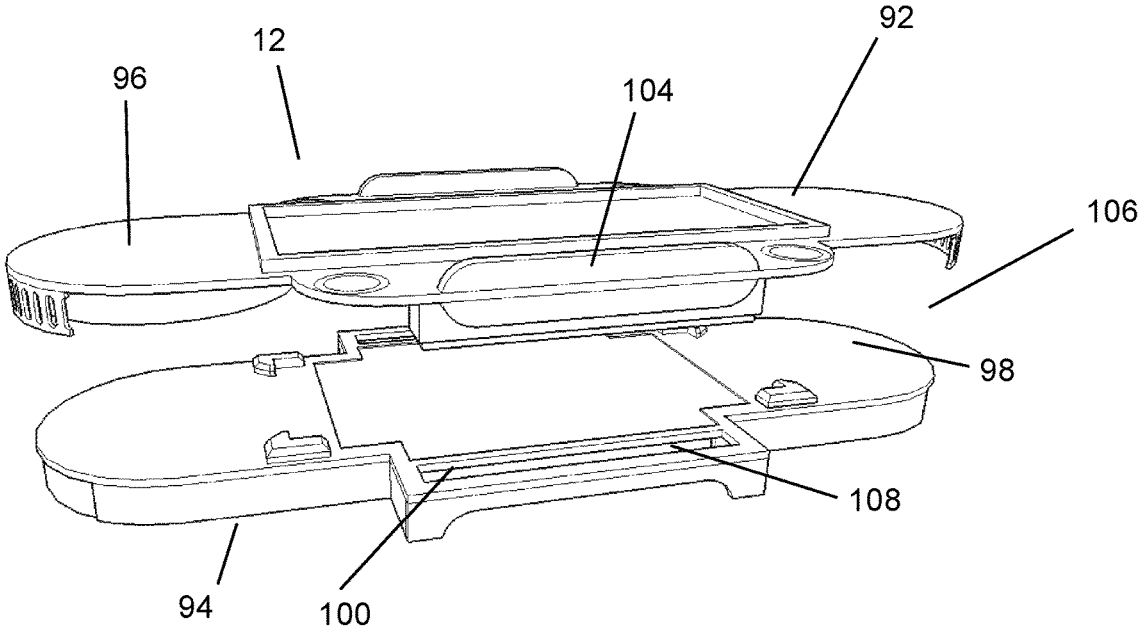
FIG. 9 is a perspective view of the reversible table top.
Figure 10:
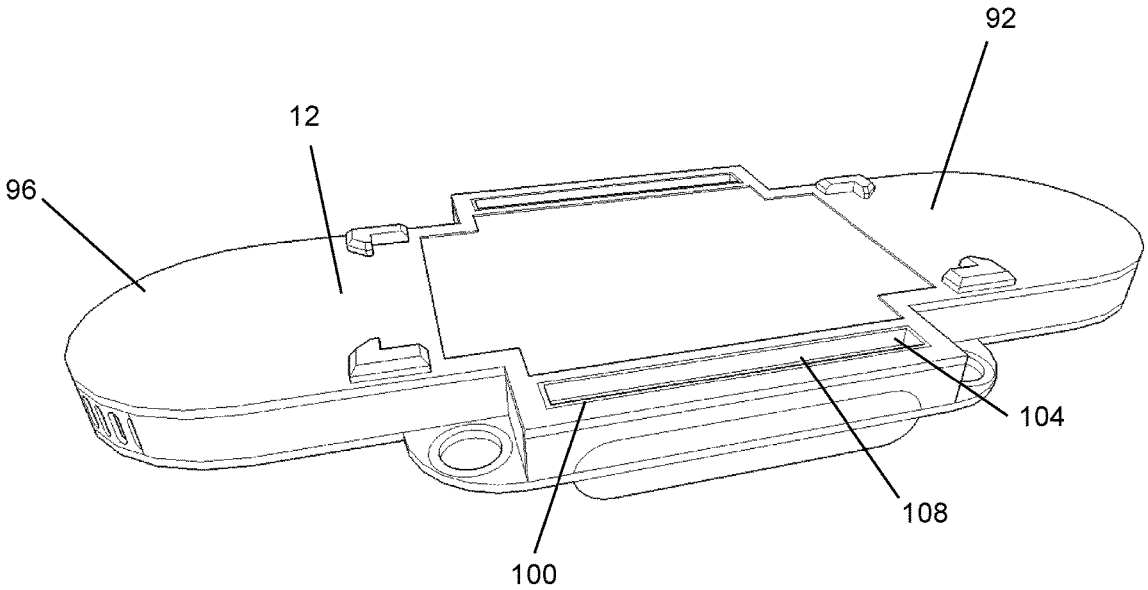
FIG. 10 is a perspective view of an embodiment of the table top which can be used for gaming in a closed position and includes a chip holder.
Figure 11:
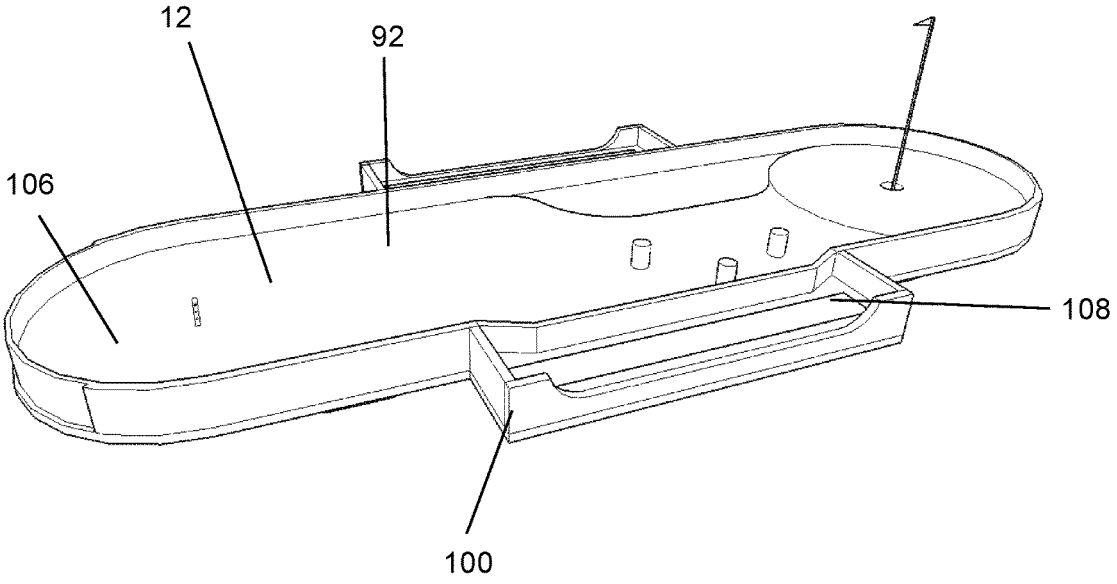
FIG. 11 is a perspective view of an embodiment of the table top which incorporates a golf game.

FIG. 7 is a perspective view of one embodiment of the stool 18 when interconnected with a second stool 18. The leg stops 44 must meet in order for the bench option 80 to properly fit. The bench option 80 has a top bench side 82, which is preferably flat, and a bottom bench side 84 which has a bench extension 86 which fits into a notch 88 defined by the support 42 and foot plate heel rest 52. The space 90 between each leg 40 which the bench extension 86 fits within.

Figure 12:
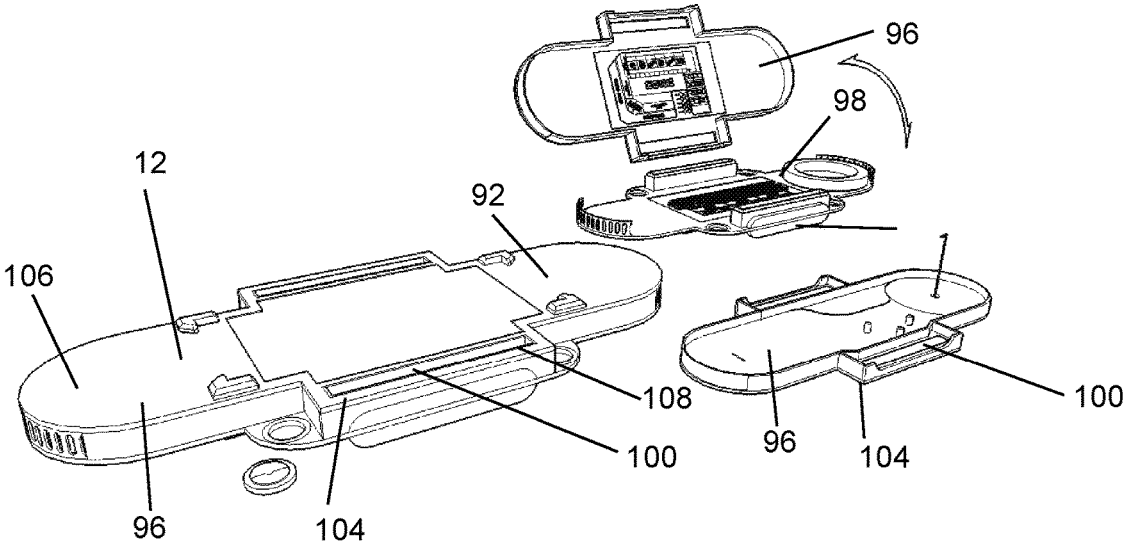
FIG. 12 is perspective view of the table top which shows how the table top opens and reverses.

FIGS. 8-12 shows an alternative embodiment of the table top 12 which can take the form of a reversible game board 92. The reversible game board 92 can be any number of games including, but not limited to, craps, roulette, card games, or mini golf. The reversible game board 92 itself has position extrusions 94 like the table top 12. As can be seen in FIG. 12, the reversible game board 92 preferably consists of a first surface 96 and second surface 98. The first surface 96 has a plurality of board openings 100 and the second surface 102 has a plurality of board projections 104 which interconnect to form a removable table top 106. The board projections 104 may also comprise chip holders 108. The first surface 100 may be flipped over and placed on top of the second surface 102 so that the user can use the reversible game board 92 as either a "table" or a "game board."

Figure 13:
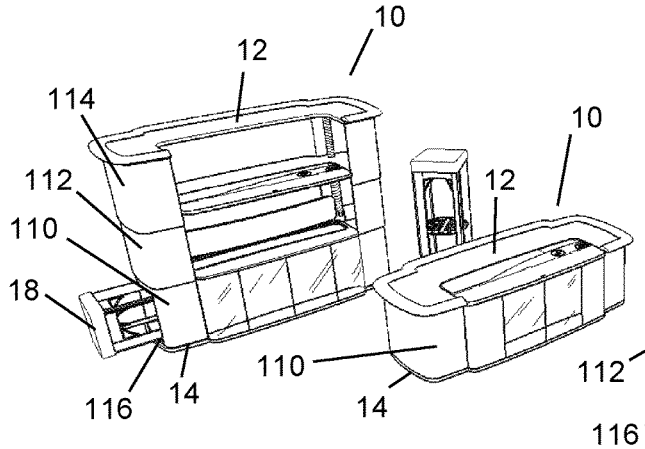
FIG. 13 is a perspective view of an alternative embodiment of the invention.
Figure 14:
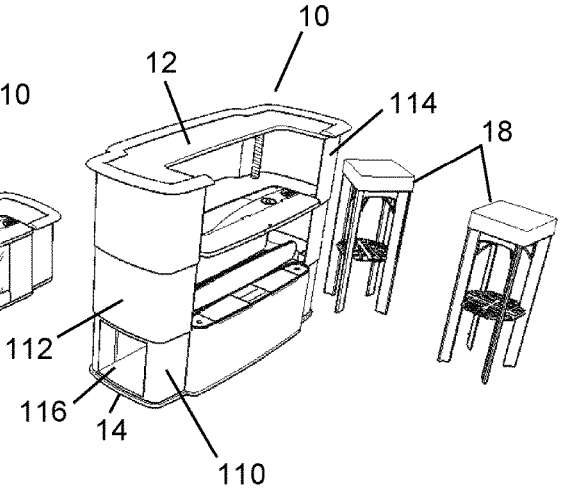
FIG. 14 is a side perspective view of the alternative embodiment of FIG. 13.
Figure 15:
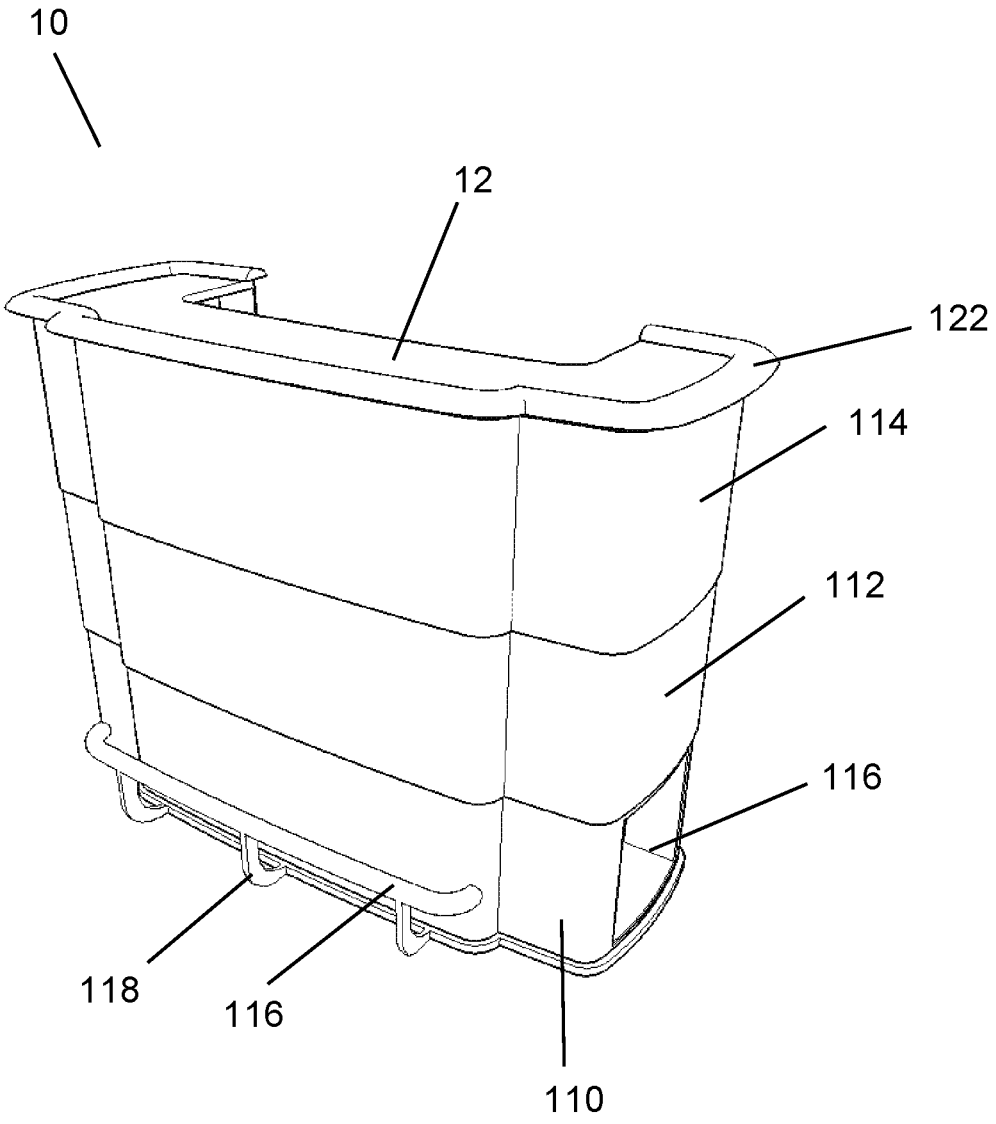
FIG. 15 is a front view of the alternative embodiment of the table fully expanded into the bar position.

FIGS. 13 and 14 show an alternative embodiment of table 10. This embodiment comprises a series of interlocking sections: the base 14, the lower section 110, the central section 112, and the upper section 114. The lower section 110 houses the stools 18. The central section 112 houses the mechanism which allows for the raising and lowering of the table 10 and which will be described in further detail below. The table 10 can be in either the "table" position or "bar" position. The stools 18 must either be housed in the lower section 110 when in the "table" position or remain outside the table 10 as the central section 112 and upper section 114 cover the entry 116 allowing the stool 18 to enter the lower section 110. As can be seen in FIG. 15, the table 10 has three sections: the lower section 110, the central section 112, and upper section 114. The lower section 110 optionally has a foot rest 116 and foot rest struts 118 for when the table 10 is in the "bar" position. The upper section 114 attaches to a table top 12 which itself is comprised of an upper surface 120 and periphery 122. The periphery 122 of the table top 12 preferably has a padded edge 124 attached to it but may also be flush with the upper section 114.

Figure 16:
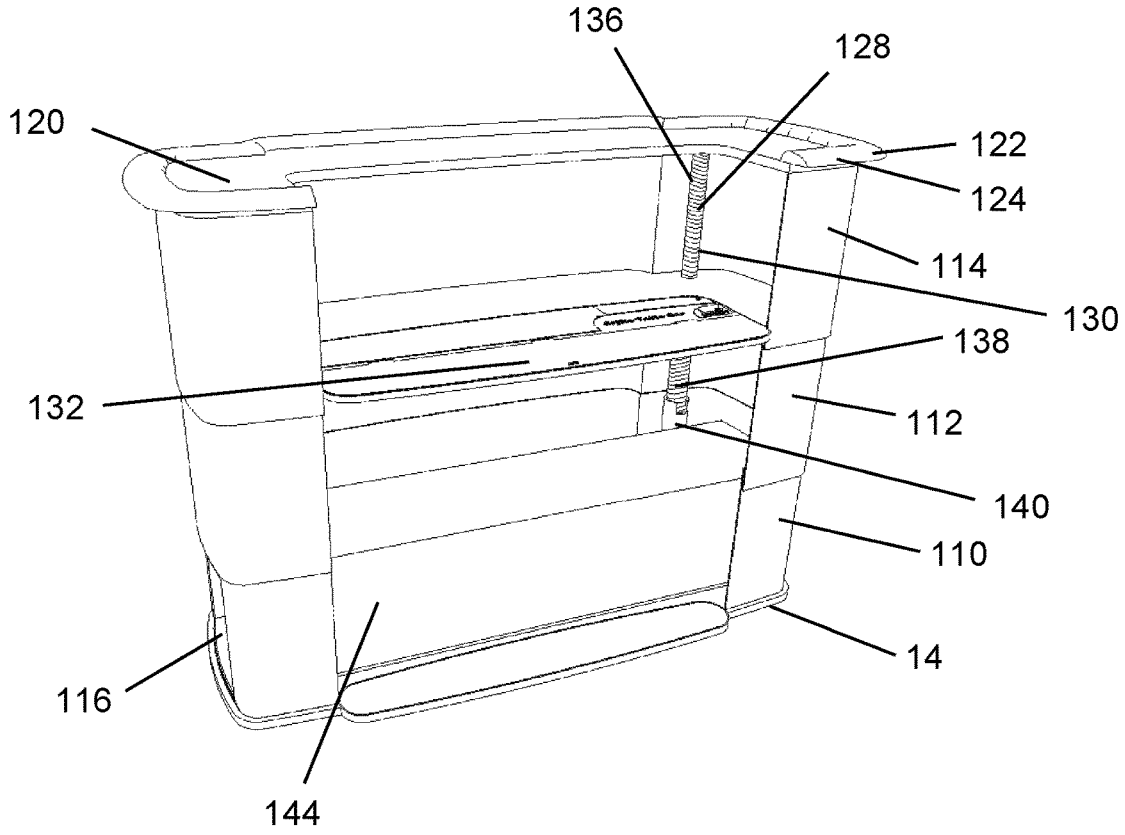
FIG. 16 is a rear view of the alternative embodiment of the table fully expanded into the bar position.

FIG. 16 provides a rear view of the alternative embodiment of the table 10. The table 10 can be raised or lowered using a series of jack screws 128, each of which has an outer housing 130. The jack screws 128 consist of upper jack screw 136, middle jack screw 138, and lower jack screw 140. The outer housing 130 is telescopic and runs from the base 14 to the table top 12. The central section 112 houses a control panel 132, described in more detail in FIG. 21 below, which controls the jack screws 128 through an interface 134. The control panel 132 and interface 134 provide power and control to the jack screws 128 to ensure the table extends to the correct height. Depending on the direction of extension, the upper jack screw 136 or lower jack screw 140 may rotate or remain still; the middle jack screw 138 will always rotate. The middle jack screw 138 must be double threaded to accommodate the upper jack screw 136 and lower jack screw 140. The middle jack screw interacts with the jack screw gear 142, described in greater detail below.

Preferably, the system is powered through batteries. The control panel 132 may also have LED lights, bar lights, or a cigarette lighter built into it based on the user's preference. The table 10 includes a notch 144 for storage of the stools 18. The notch 144 may include space for storage of other items such as wine, towels, beverages, or other small items the user may need.

Figure 17:
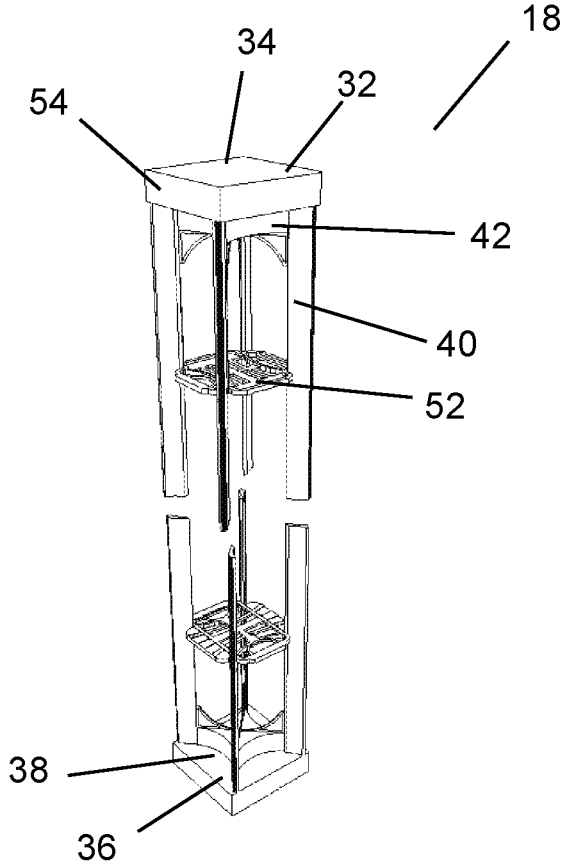
FIG. 17 is a perspective view of an alternative embodiment of the stools.

FIG. 17 depicts an alternative embodiment of the stools 18. This alternative embodiment has a square-shaped seat but is otherwise functionally identical to the previously described stool 18. The legs 40 slide together and interconnect for easy storage within the table 10.

Figure 18:
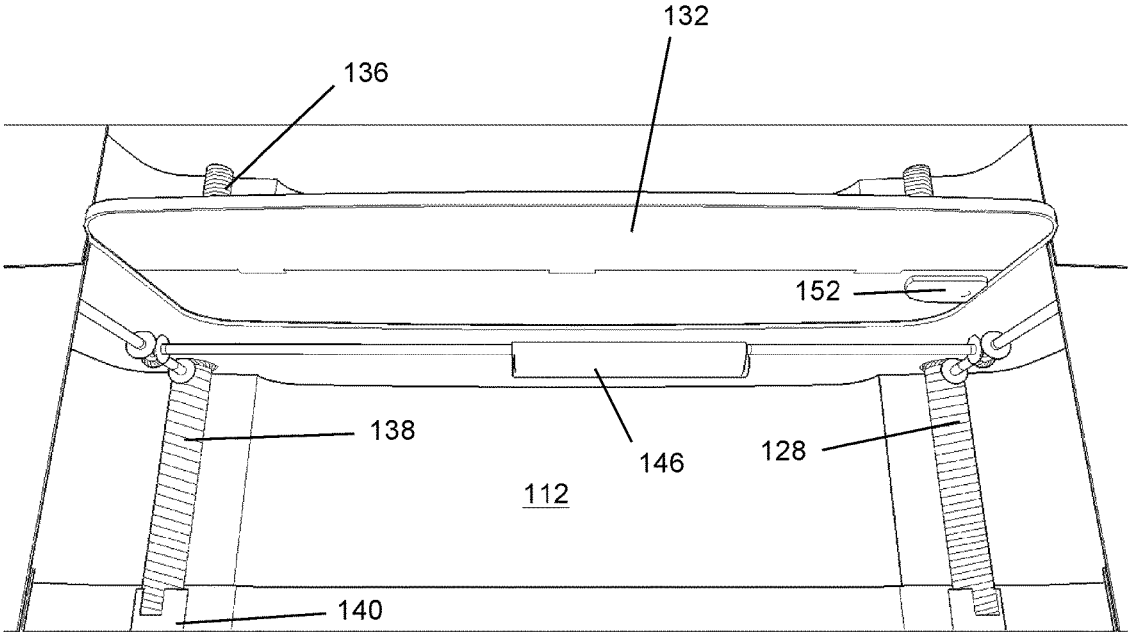
FIG. 18 is an interior view of the table and the jack screws used to raise/lower the table.
Figure 19:
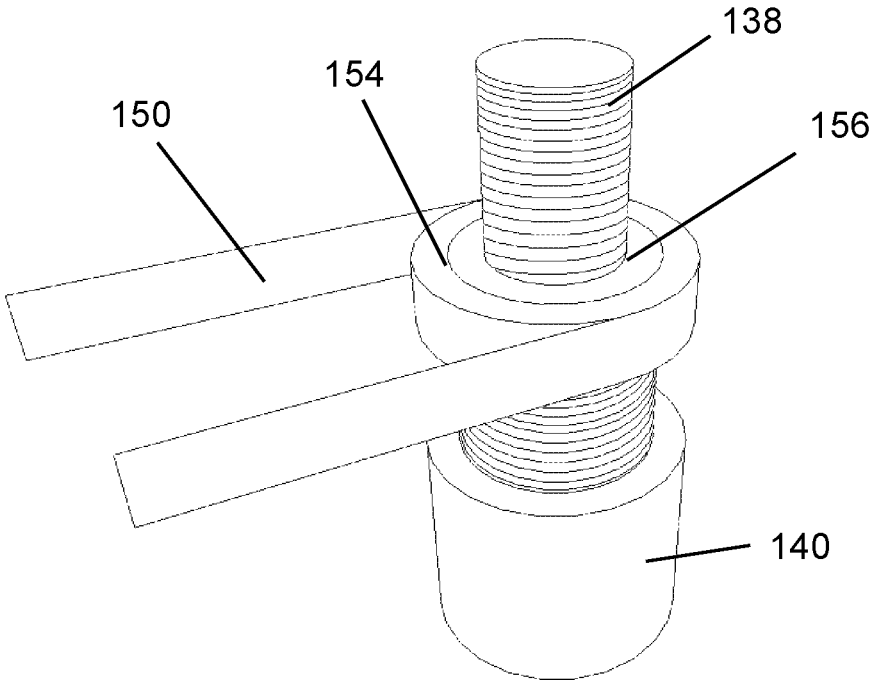
FIG. 19 is a close-up view of belt-based rotor used to manipulate the jack screws to raise/lower the table.
Figure 20:
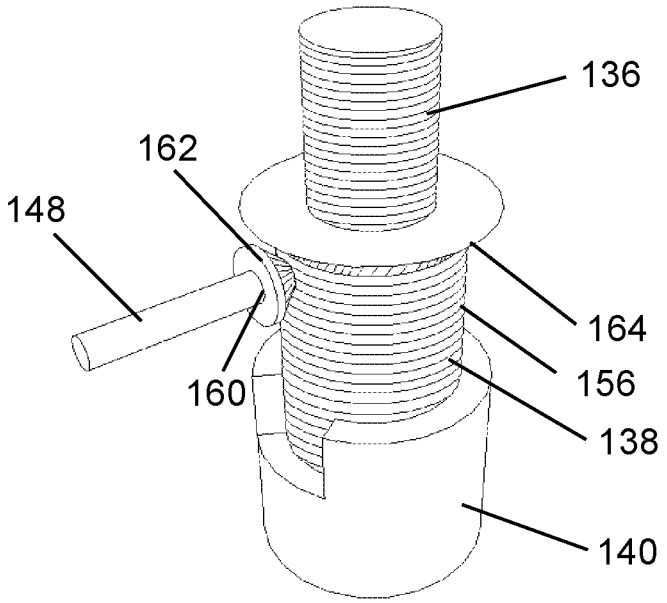
FIG. 20 is a close-up view of a drive shaft-based rotor used to manipulate the jack screws to raise/lower the table.

FIG. 18 is a perspective view of the central section 112 and, in particular, the control panel 132 and jack screws 128. The jack screws 128 can be run one of two ways using either a drive shaft 148 or a belt/chain 150. The motor 146 either turns the drive shaft 148 or pulls the belt/chain 150 in the standard fashion. The control panel 132 houses a control box 152 which houses all of the controls, circuit boards, and other electronics of the table 10. FIGS. 19 and 20 depict the belt/chain driven method and drive shaft method respectively. As shown in FIG. 19, the belt/chain 150 wraps around a cam 154 which is attached to the jack screw shaft 156. The motor 146 pulls the belt/chain 150 which in turn rotates the cam 154. This rotation leads to the table 10 rising or falling depending on the rotation direction. FIG. 20 shows the drive shaft 148 which at its proximate end 160 comprises a tapered gear 162 which is generally in contact with the jack screw gear 164 which is attached to the jack screw shaft 156. The motor rotates the drive shaft 148 thereby rotating the tapered gear 162 which in turn rotates the jack screw gear 164 which rotates the jack screw shaft 156 thereby raising or lowering the table 10.

Figure 21:
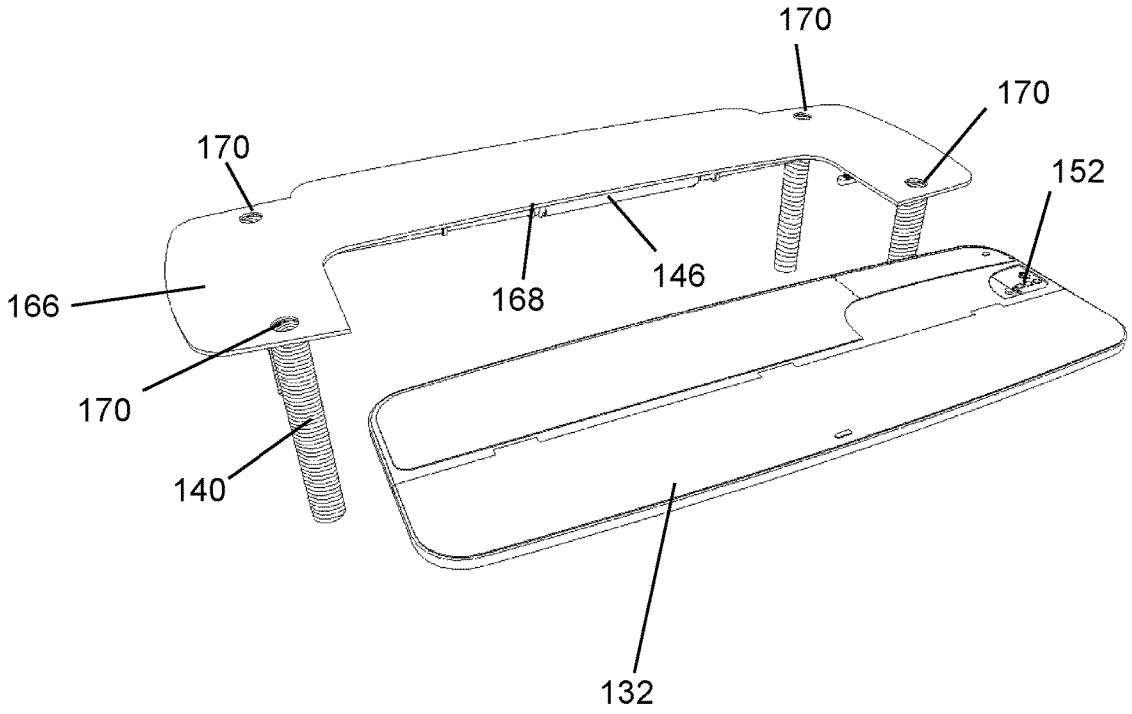
FIG. 21 is an exploded view of the control panel which controls the jack screws and a middle section of the table shown in FIG. 13.
Figure 22:
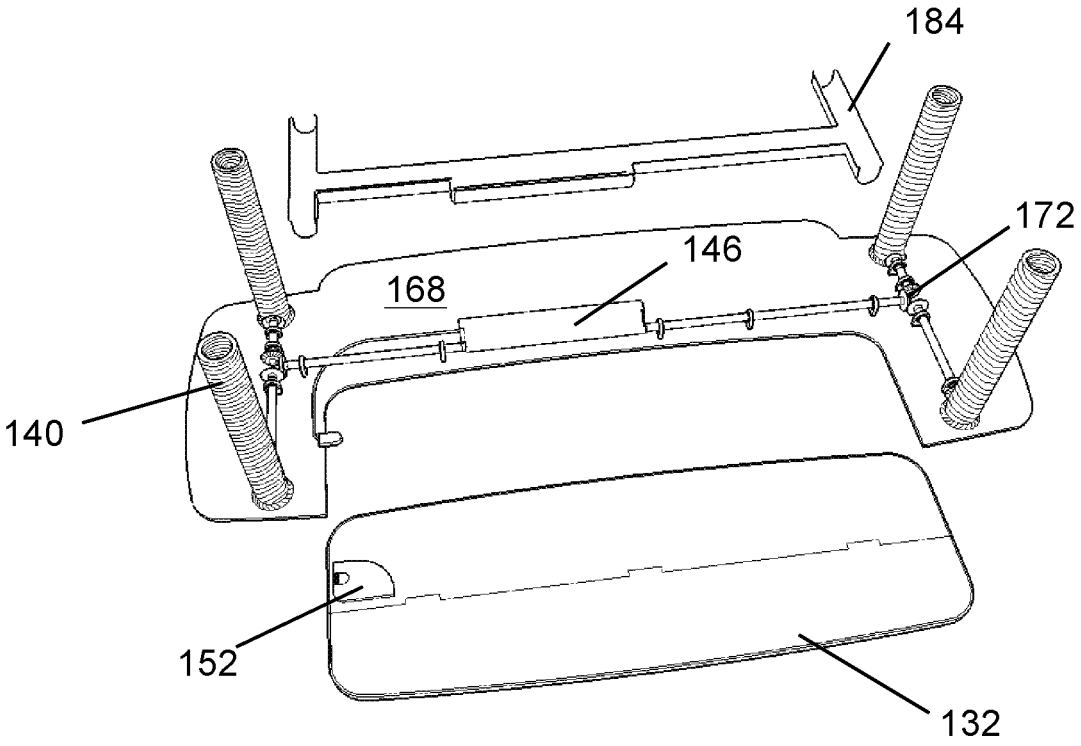
FIG. 22 is an bottom view of the control panel.

As can be seen in FIG. 21, the control panel 132 is detachable. The motor 146 is attached to the central section surface underside 168. The central section surface 166 has a plurality of openings 170 for the jack screws 128. FIG. 22 shows an underside view of the control panel 132 and central section surface underside 168. The intersection 172 of the drive shaft and/or chain/belt is similar to a differential in an automobile such that each jack screw 128 ends up rotating at the same average rotational velocity.

Figure 23:
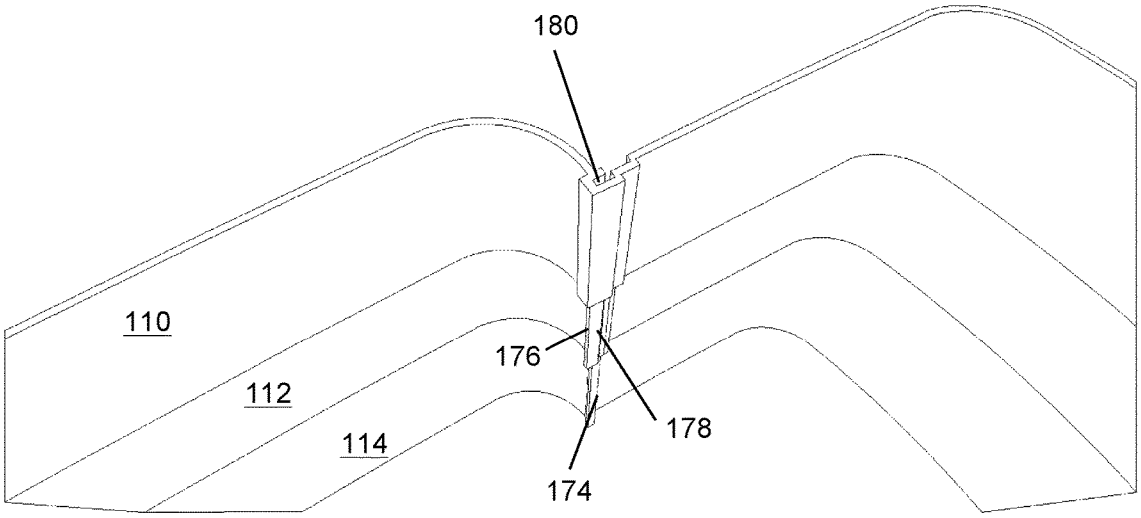
FIG. 23 is a bottom perspective view of one of the telescoping joints of the table shown in FIG. 13.
Figure 24:
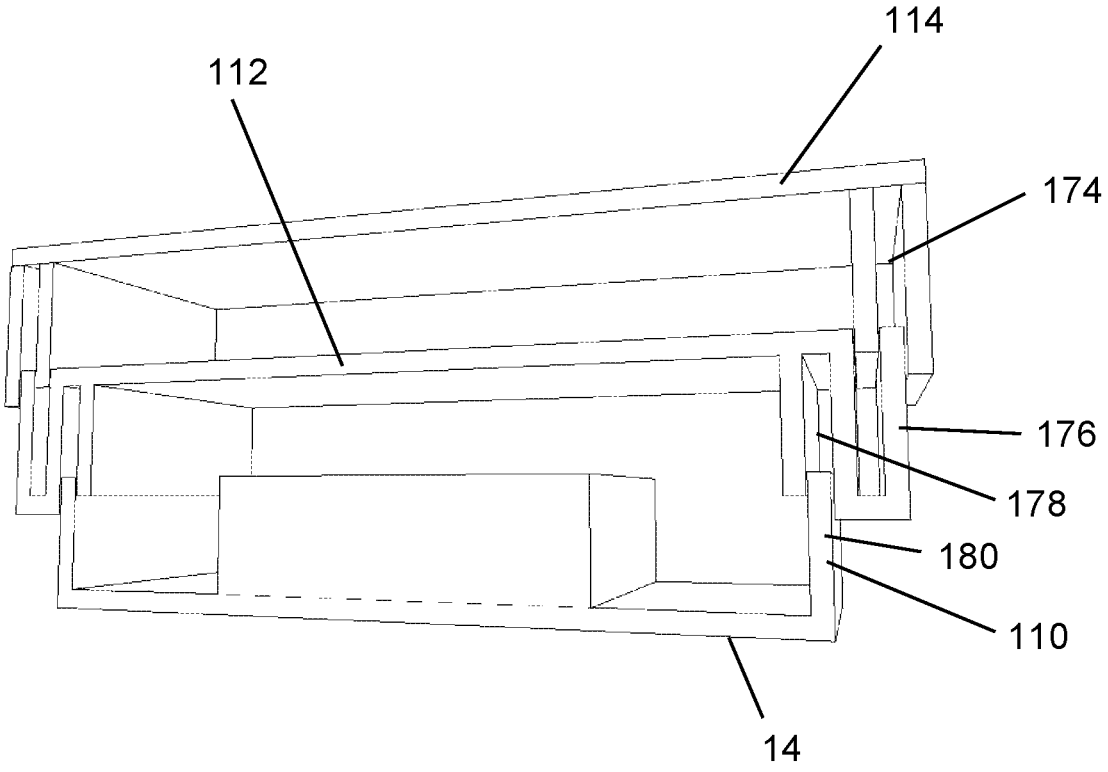
FIG. 24 is a side cross-sectional view of the table showing the telescoping sections of the table.
Figure 25:
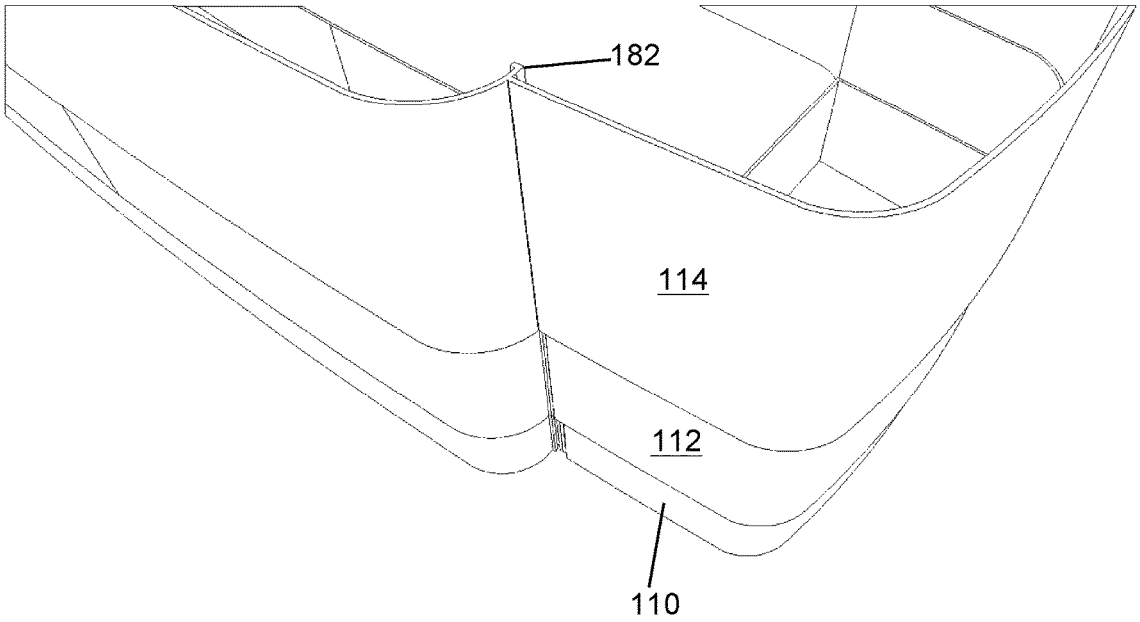
FIG. 25 is a top perspective view of the table without the table top showing the telescoping sections of the table.
Figure 26:
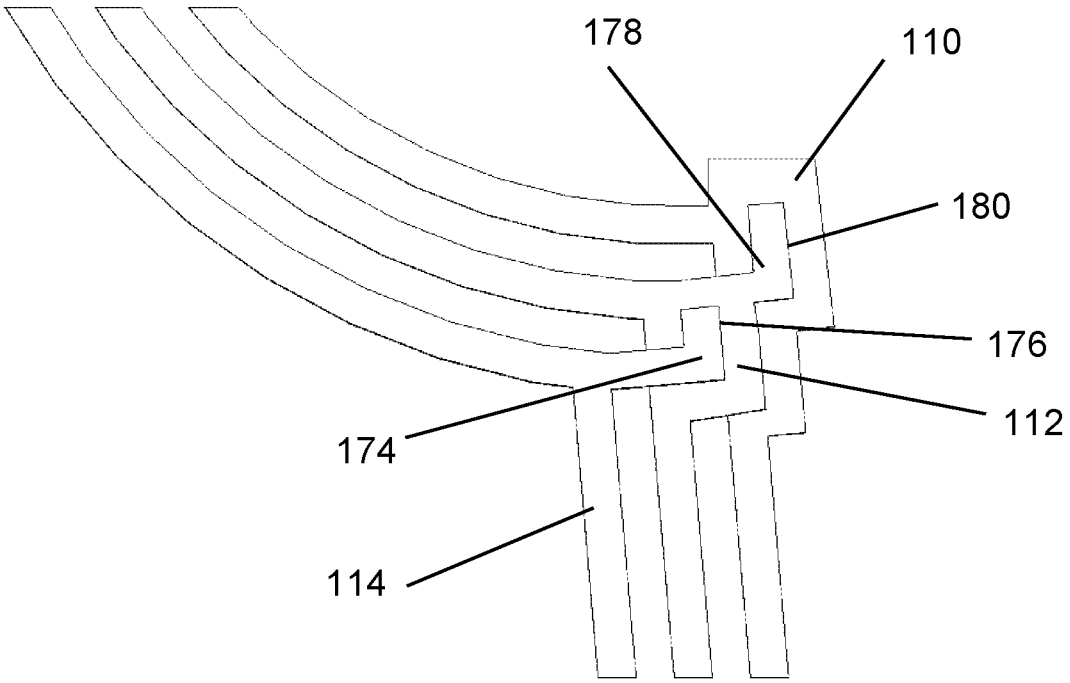
FIG. 26 is a cross-sectional view of the bottom of the telescoping sections of the table.

FIG. 23 is a cross-sectional view of the lower section 110, the central section 112, and the upper section 114. As can be seen from this view, the upper section 114 has an upper section extension 174. The central section 112 has a central section groove 176 which fits into upper section extension 174 so that the upper section 114 slidably moves over the central section 112. Similarly, the central section 112 has a central section extension 178 and the lower section 110 has a lower section groove 180 which fits onto central section groove 176 so that the central section 112 slidably moves into the lower section 110. FIG. 24 shows a different cross-section of the table 10 showing how the upper section 114 connects to the central section 112 which connects to the lower section 110. FIG. 25 depicts an optional corner guide 182 which is helpful for alignment and support. FIG. 26 is another, different, cross-sectional view of the lower section 110, central section 112, and upper section 114 and how each section connects.

Figure 27:
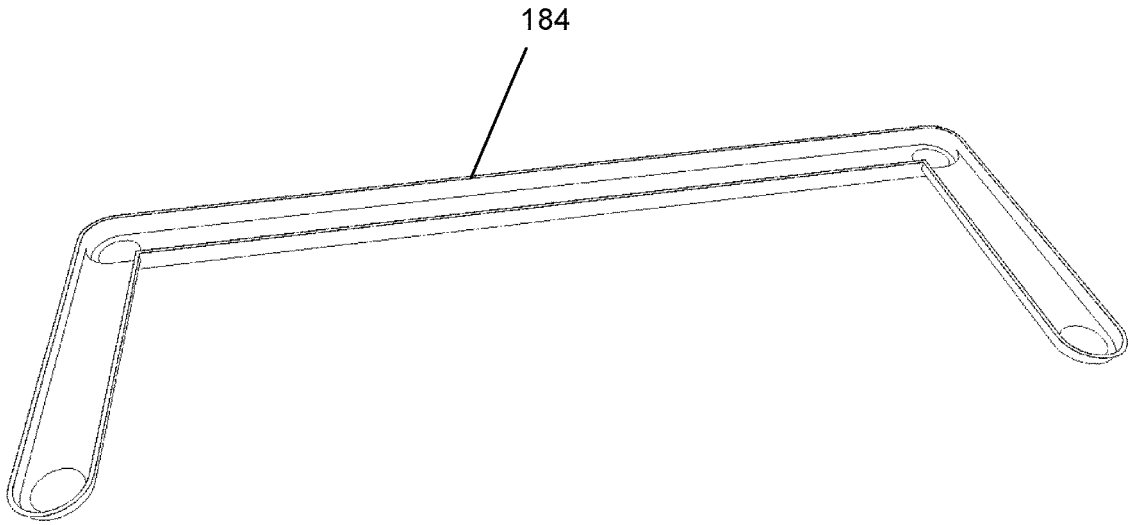
FIG. 27 is a perspective view of the protective cover used to protect the belt and/or drive shaft.

FIG. 27 is a perspective view of the protective cover 184 which is placed over the drive shaft 148 or belt/chain 150. It is preferably attached to the central section surface underside 168.

Figure 28:
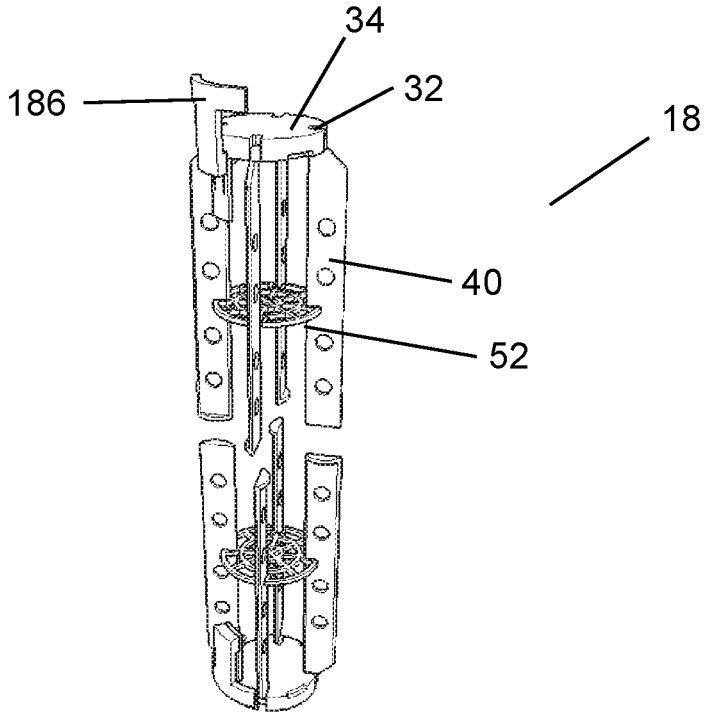
FIG. 28 is a perspective view of an alternative embodiment of the stools.

FIG. 28 is an alternative embodiment of the stools 18. This embodiment features a back rest 186 attached to the seat 32 and a plurality of legs 40. The legs 40 are preferably thin longitudinally and have a uniform thickness. The foot plate heel rest 52 is preferably circular but can be any shape so long as it prevents the stools 18 from advancing too far when connecting for storage since the legs 40 slidably interconnect as in the previous embodiments of the stools 18.

Figure 32:
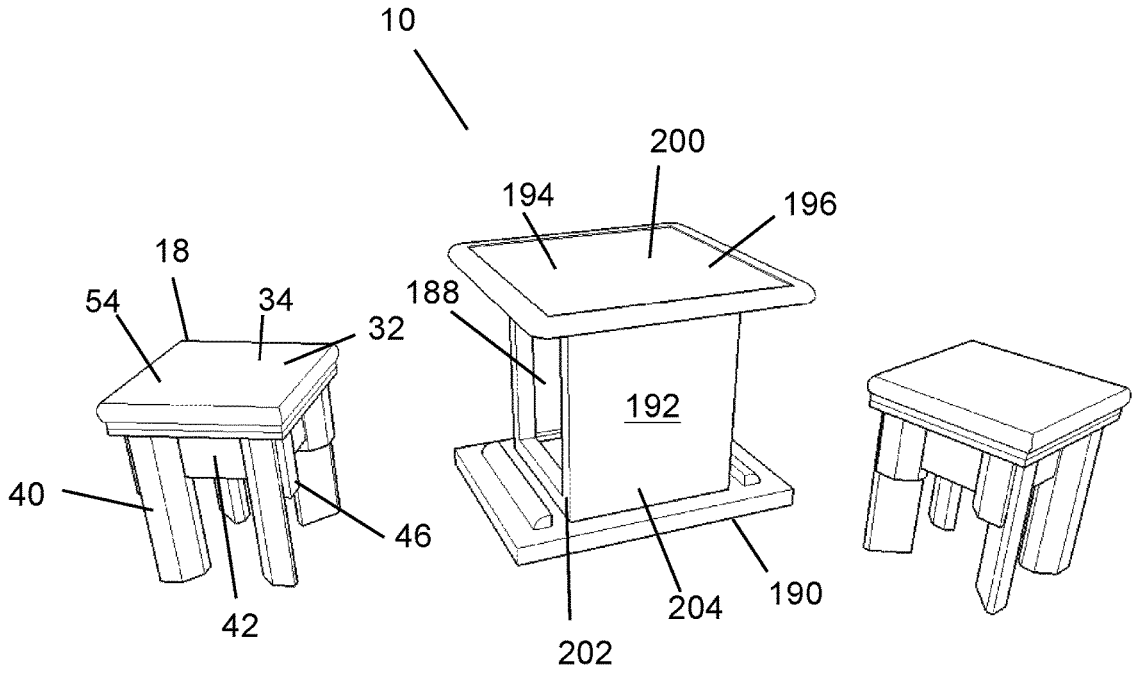
FIG. 32 is a perspective view of an alternative embodiment of the table with the stools removed.
Figure 33:
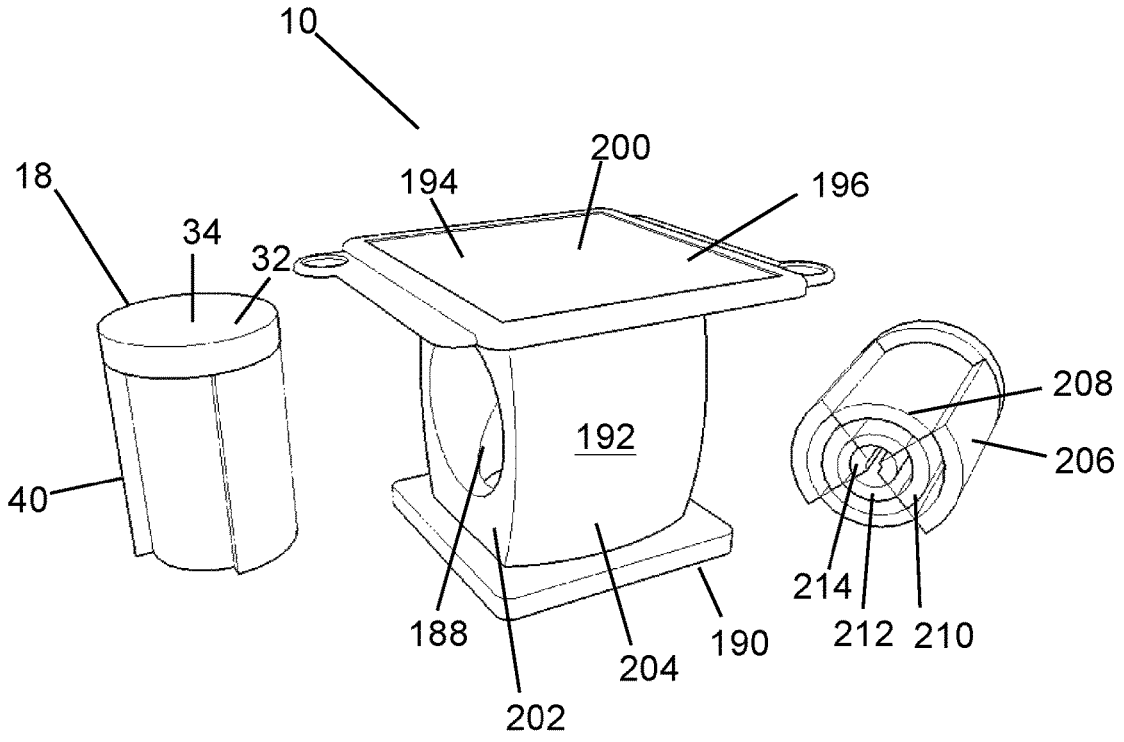
FIG. 33 is a perspective view of an alternative embodiment of the table with the stools removed.
Figure 34:
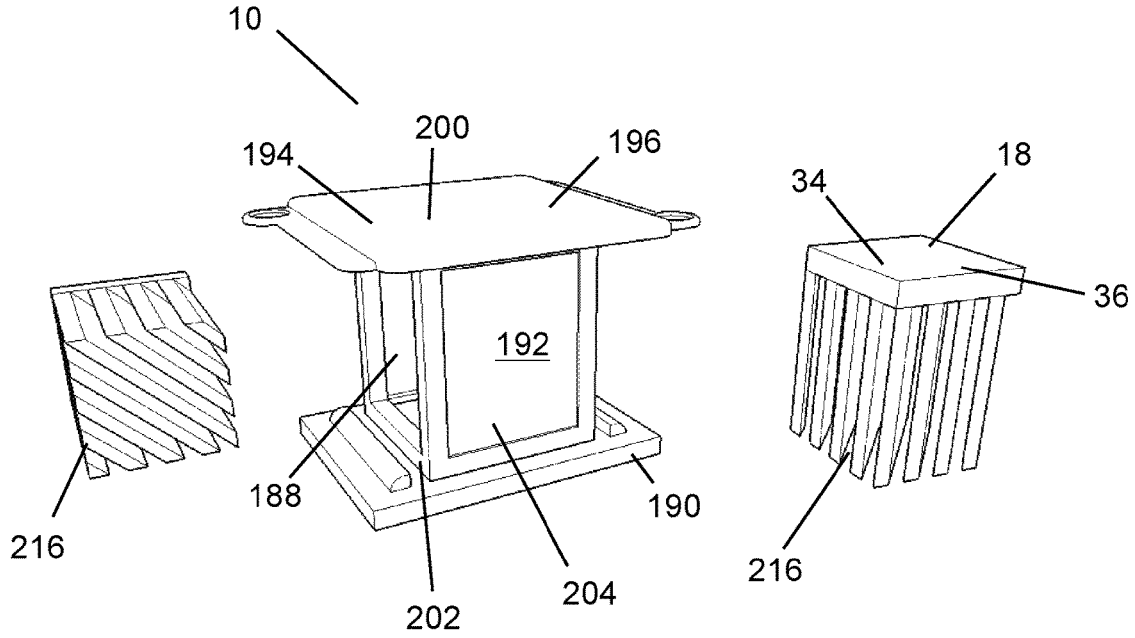
FIG. 34 is a perspective view of an alternative embodiment of the table with the stools removed.

FIGS. 29, 30, and 31 depict an alternate embodiment of the table 10. This embodiment features a single opening 188 for the stools 18 and is viewed as more of an end table. This alternate embodiment of table 10 has a base 190, central section 192, and table top 194 which itself is comprised of topside 196 and underside 198. The topside 196 has an impression 200 which allows for other objects such as board games to be placed thereon. The central section 192 comprises a first side 202 and second side 204 with the opening 188 being located through the entirety of either the first side 202 or second side 204. If desired, the central section 192 can be rotated to give the table 10 a different height. This arrangement can be seen more clearly in FIGS. 32, 33, and 34 which depict various embodiments of table 10. FIG. 32 provides an embodiment wherein the table 10 and stools 18 are generally square. FIG. 33 provides an embodiment wherein the table 10 is generally square and stools 18 are generally round with the stools 18 further comprising a seat 32 and legs 40 with legs 40 further comprising first outer segment 206, first inner segment 208, second outer segment 210, second inner segment 212, and central segment 214. FIG. 34 provides an embodiment wherein the table 10 and stools 18 are generally square with the stools 18 further comprising a seat 32 and legs 40 with legs 40 further comprising a plurality of slanted supports 216. When inserted into the opening 188, the slanted supports 216 preferably enmesh themselves together so that the stools 18 can fit snugly in the opening 188.

What is claimed is:

1. A multi-configurable furniture system comprising:

a table further comprising:

a hinged mid-section further comprising at least two frames comprising an interior void connected by a hinge having a plurality of height adjustment holes arranged in a grouping along at least one edge of each frame; a detachable table top in communication with a platform frame having position extrusions which lock the mid-section into place using a top slide latch comprising slide latch pins which connect the table top to at least one grouping of the height adjustment holes; and a detachable base which can attach to each frame using a base slide latch in combination with a second pair of height adjustment holes; and a plurality of stools wherein each stool may be removably housed in the interior void of the frames of the mid-section.

2. The table of claim 1 wherein the hinging mid-section can be folded using the hinge to adjust the hinging mid-section's height or width.

3. The table of claim 2 wherein the height or width of the hinging mid-section determines whether the table is in a raised or lowered position.

4. The table of claim 1 wherein the stools further comprise a plurality of complementary legs that can be interconnected to form a bench.

5. The table of claim 1 wherein the detachable base further comprises base protrusions wherein said frames fit onto the protrusions which lock the mid-section into place using the base slide latch.

6. The table of claim 5 wherein the base protrusions comprise inner protrusions, middle protrusions, and outer protrusions, the use of which determines the position of the hinging mid-section.

7. The table of claim 1 wherein the table top comprises a reversible game board further comprising a plurality of board game board protrusions which lock into place on the hinging mid-section using the top slide latch.

8. The table of claim 7 wherein the reversible game board has a craps table design.

9. The table of claim 7 wherein the reversible game board has a roulette table design.

10. The table of claim 7 wherein the reversible game board has a card game design.

11. The table of claim 7 wherein the reversible game board has a mini golf game design.

12. The table of claim 1 wherein each stool further comprises a seat, a plate, and a foot plate heel rest.

13. A multi-configurable furniture system comprising:

a table further comprising:

a series of interlocking telescoping sections comprising a base, a lower section, a central section, and an upper section, wherein the central section houses an interface and detachable control panel; a table top comprising a top side and a bottom side, the bottom side being in communication with the upper section, and the top side having a periphery;

at least two jack screws for raising or lowering the table's height, each jack screw further comprising an upper jack screw, a middle jack screw, and a lower jack screw with each controlled by the interface and detachable control panel, wherein the lower jack screw is connected to the base and the upper jack screw is connected to the table top;

a jack screw gear attached to the central section for rotating one of the upper jack screw, middle jack screw, or lower jack screw either clockwise or counterclockwise; and a plurality of slidably interconnectable stools.

14. The table of claim 13 wherein the upper section further comprises an upper section extension, the central section further comprises a central section groove which fits into the upper section extension and a central section extension, and the lower section further comprises a lower section groove which fits into the central section extension.

15. The table of claim 13 wherein each jack screw is protected by an outer housing.

16. The table of claim 13 wherein the jack screw gear is protected by a protective cover.

17. The table of claim 13 wherein the jack screw gear rotates using a drive shaft.

18. The table of claim 13 wherein the jack screw gear rotates using a belt.

19. The table of claim 13 wherein each interlocking telescoping section further comprises a corner guide.

20. The table of claim 13 wherein the table top comprises a reversible game board.

21. The table of claim 20 wherein the reversible game board has a craps table design.

22. The table of claim 21 wherein the reversible game board has a roulette, table design.

23. The table of claim 21 wherein the reversible game board has a card game design.

24. The table of claim 21 wherein the reversible game board has a mini golf game design.

* * * * *